US007959763B2

(12) United States Patent
MacHattie et al.

(10) Patent No.: US 7,959,763 B2
(45) Date of Patent: Jun. 14, 2011

(54) APPARATUS AND METHOD FOR CORRECTING BASIS WEIGHT MEASUREMENTS USING SURFACE TOPOLOGY MEASUREMENT DATA

(75) Inventors: Ross K. MacHattie, Mississauga (CA); Anders Hallgren, Gustavsberg (SE)

(73) Assignee: Honeywell International Inc., Morristown, NJ (US)

( * ) Notice: Subject to any disclaimer, the term of this patent is extended or adjusted under 35 U.S.C. 154(b) by 559 days.

(21) Appl. No.: 12/034,513

(22) Filed: Feb. 20, 2008

(65) Prior Publication Data

US 2009/0205796 A1 Aug. 20, 2009

(51) Int. Cl.
*D21F 7/06* (2006.01)
*G01N 33/34* (2006.01)

(52) U.S. Cl. ... 162/198; 162/263; 162/111; 162/DIG. 6; 162/DIG. 10; 73/159

(58) Field of Classification Search ..... 162/111, 162/198, 363, 254, 258, 259, 262, DIG. 6, 162/DIG. 10, DIG. 11, 263; 250/559.08, 250/559.01, 339.1; 700/127–129; 356/909, 356/237.5, 431, 628, 629; 73/159
See application file for complete search history.

(56) References Cited

U.S. PATENT DOCUMENTS

| | | | | |
|---|---|---|---|---|
| 3,196,072 | A * | 7/1965 | Wirtz | 162/198 |
| 5,243,407 | A * | 9/1993 | King et al. | 356/429 |
| 5,269,883 | A | 12/1993 | Beuther | |
| 5,277,761 | A * | 1/1994 | Van Phan et al. | 162/109 |
| 5,512,139 | A * | 4/1996 | Worcester | 162/111 |

* cited by examiner

*Primary Examiner* — Eric Hug
(74) *Attorney, Agent, or Firm* — Munck Carter, LLP

(57) ABSTRACT

An apparatus and method for correcting an areal weight measurement of a stretchable web using surface topology measurement data is disclosed. Areal weight may comprise a basis weight or a water weight. The apparatus measures a surface of the stretchable web with a basis weight measuring device to obtain a rough basis weight measurement. The apparatus then measures the surface of the stretchable web with a surface topology measuring device to obtain surface topology measurement data. The apparatus comprises a controller that corrects the rough basis weight measurement of the stretchable web using surface topology measurement data. The corrected basis weight measurement may be used as a feedback value in a real time manufacturing process of the stretchable web.

25 Claims, 8 Drawing Sheets

APPARATUS AND METHOD FOR CORRECTING BASIS WEIGHT MEASUREMENTS USING SURFACE TOPOLOGY MEASUREMENT DATA

TECHNICAL FIELD

This disclosure relates generally to the manufacture of stretchable webs such as creped tissue paper and more specifically to an apparatus and method for correcting the measurements of basis weight of such stretchable webs using surface topology measurement data.

BACKGROUND

In the manufacture of a stretchable web such as creped tissue paper, the basis weight of a stretchable web is an important parameter. Basis weight is a measure of mass per unit area of the web. Basis weight is usually expressed in terms of grams per square meter. Typical basis weight values may range from ten to seventy grams per square meter. As will be more fully described, there are prior art systems that exist that measure the basis weight of a stretchable web in real time during the manufacturing process of the stretchable web.

The principles of the present invention will be described with reference to the measurement of a basis weight of creped tissue paper. It is understood that the principles of the invention are not limited to the particular example of creped tissue paper and that the principles of the invention are applicable to the measurement of basis weight for all types of stretchable webs, including, without limitation, all types of creped or embossed tissue material and paper towels.

FIG. 1 illustrates a schematic representation of an exemplary prior art machine 100 for making creped tissue paper. A source (not shown) provides an aqueous slurry of paper fibers to a headbox 110. The headbox 110 deposits the slurry onto a first wire structure 120. The first wire structure allows water from the slurry to drain away and leave a web of paper fibers on the first wire structure 120. The first wire structure 120 that carries web of paper fibers is moved laterally in a continuous loop by a plurality of rollers as shown in FIG. 1.

The web of paper fibers is transferred to a press felt 130 as shown in FIG. 1. The press felt 130 carries the web of paper fibers to a pressure roll 140. The pressure roll 140 transfers the web of paper fibers to surface of a creping cylinder 150. The creping cylinder 150 (also commonly referred to as a Yankee dryer 150). The Yankee dryer 150 dries the web of paper fibers as the Yankee dryer rotates.

The dried web of paper fibers is subsequently removed from the Yankee dryer 150 by the application of a creping doctor 160. The creping doctor 160 comprises a creping blade that forms crepe structures in the web of paper fibers. The resulting creped web of paper fibers is collected on a reel drum 170.

The basis weight of the resulting creped web of paper fibers may be measured in real time using measuring devices (not shown in FIG. 1) that are located within a device that is referred to as a reel scanner 180. The reel scanner 180 is located between the creping doctor 160 and the reel drum 170. The creped web of paper fibers passes through the reel scanner 180. During the continuous manufacture of the creped web of paper fibers, the measuring devices that are located within the reel scanner 180 are employed to measure the basis weight of the creped web of paper fibers at any desired time.

FIG. 2 schematically illustrates three prior art basis weight measuring devices that are used to measure the basis weight of a creped web of paper fibers. The creped web of paper fibers is designated with reference numeral 205. Assume that the web 205 in FIG. 2 is moving laterally from left to right. The three basis weight measuring devices that are shown in FIG. 2 are illustrated for descriptive purposes. In an actual implementation it is likely that only one basis weight measuring device would be used.

The first basis weight measuring device comprises a source 210 and a detector 220 of beta particle radiation. The source 210 exposes the web 205 to beta particles. Some of the beta particles penetrate the web 205 and reach the detector 220 that is located on the other side of the web 205. The beta particle detector 220 measures how many beta particles have penetrated the web 205. By knowing the original intensity of the beta particle radiation from the source 210 and the detected intensity of transmitted beta particle radiation at the detector 220, one can determine an estimate of the basis weight of the web 205 in real time.

The second basis weight measuring device comprises a light source 230 and a light detector 240. The source 230 exposes the web 205 to light having a selected wavelength. A portion of the light that is incident on the web 205 penetrates the web 205 and reaches the detector 240 that is located on the other side of the web 205. The light detector 240 measures how much light penetrates the web 205. By knowing the original intensity of the light from the light source 230 and the detected intensity of the transmitted light at the light detector 240, one can determine a rough estimate of the basis weight of the web 205 in real time.

The third basis weight measuring device comprises an infrared source 250 and an infrared detector 260. The source 250 exposes the web 205 to infrared light having at least two selected wavelengths. A portion of the light that is incident on the web 205 is reflected from the web 205 and reaches the infrared detector 260 that is located on the same side of the web 205. The infrared detector 260 measures the ratio of wavelengths reflected from the web 205. By knowing the ratio, one can determine an estimate of the basis weight of the web 205 in real time.

The estimate of the basis weight of the web 205 can be used as feedback information to control the manufacturing process of the web 205. For example, basis weight values can be used to control a fan pump that regulates the amount of slurry material that is provided to the headbox 110. Basis weight values can also be used as an indicator of blade wear of the creping blade in the creping doctor 160. It is therefore important to obtain a measurement of the basis weight of the web 205 that is as accurate as possible.

The velocity of the web 205 goes to zero as the web 205 encounters the creping blade of the creping doctor 160. The web 205 then accelerates back to machine velocity on its way to the reel drum 170. Due to the creping of the web 205, the web 205 is somewhat elastic. Therefore the velocity of the web 205 oscillates around the value of the machine velocity as the web 205 moves from the creping doctor 160 to the reel drum 170.

To accommodate the various velocities, the crepes are either pulled out or compressed. Depending upon the location where the basis weight measurement is made, there could be more material or less material under the sensor of the basis weight measuring device than there would be in the finished web 205 at rest. Furthermore, the rate at which the crepe is pulled out between the creping doctor 160 and the reel drum 170 may be different depending upon factors such as the condition of the creping doctor 160, the weight of the web 205, moisture content, etc. Variations in these factors may cause the basis weight measurement of the web 205 to be in error.

To compensate for these variations some prior art approaches measure the velocity of the web 205 at the location where the basis weight measurement is made and then compare the measured velocity with the velocity of reel drum 170. Then a correction is calculated to obtain a more accurate value for the basis weight measurement.

It would be desirable to have an even more accurate and precise method for correcting a basis weight measurement of a stretchable web in real time during the manufacturing process of the stretchable web.

SUMMARY

This disclosure provides an apparatus and method for accurate and precise method for correcting a basis weight measurement of a stretchable web in real time during the manufacturing process of the stretchable web using surface topology measurement data.

The method of the present invention measures the basis weight of the web using two different measurement techniques. The first measurement is a prior art basis weight measurement that may be made by using any one of a plurality of prior art basis weight measurement techniques. The first measurement obtains a rough measurement of the basis weight of the web. The second measurement is a measurement of the surface topology of the web at or very near the same location where the prior art basis weight measurement is made. The surface topology measurement may be made by using a scanning camera.

In an advantageous embodiment of the apparatus and method of the invention, a controller is provided that (1) receives a rough basis weight measurement of a web from a prior art basis weight measuring device, and (2) receives a surface topology measurement data of the web at or near the point of the rough basis weight measurement of the web, and (3) combines the two measurements to form an accurate basis weight measurement of the web in real time. The controller of the invention stores the accurate basis weight measurement of the web in a data storage unit. The accurate basis weight measurement can be used as a feedback value for a process in the manufacture of the web.

Other technical features may be readily apparent to one skilled in the art from the following figures, descriptions, and claims.

BRIEF DESCRIPTION OF THE DRAWINGS

For a more complete understanding of this disclosure, reference is now made to the following description, taken in conjunction with the accompanying drawings, in which.

DETAILED DESCRIPTION

FIGS. 3 through 11 and the various embodiments used to describe the principles of the present invention in this patent document are by way of illustration only and should not be construed in any way to limit the scope of the invention. Those skilled in the art will understand that the principles of the invention may be implemented in any type of suitably arranged device or system.

Figure 1:
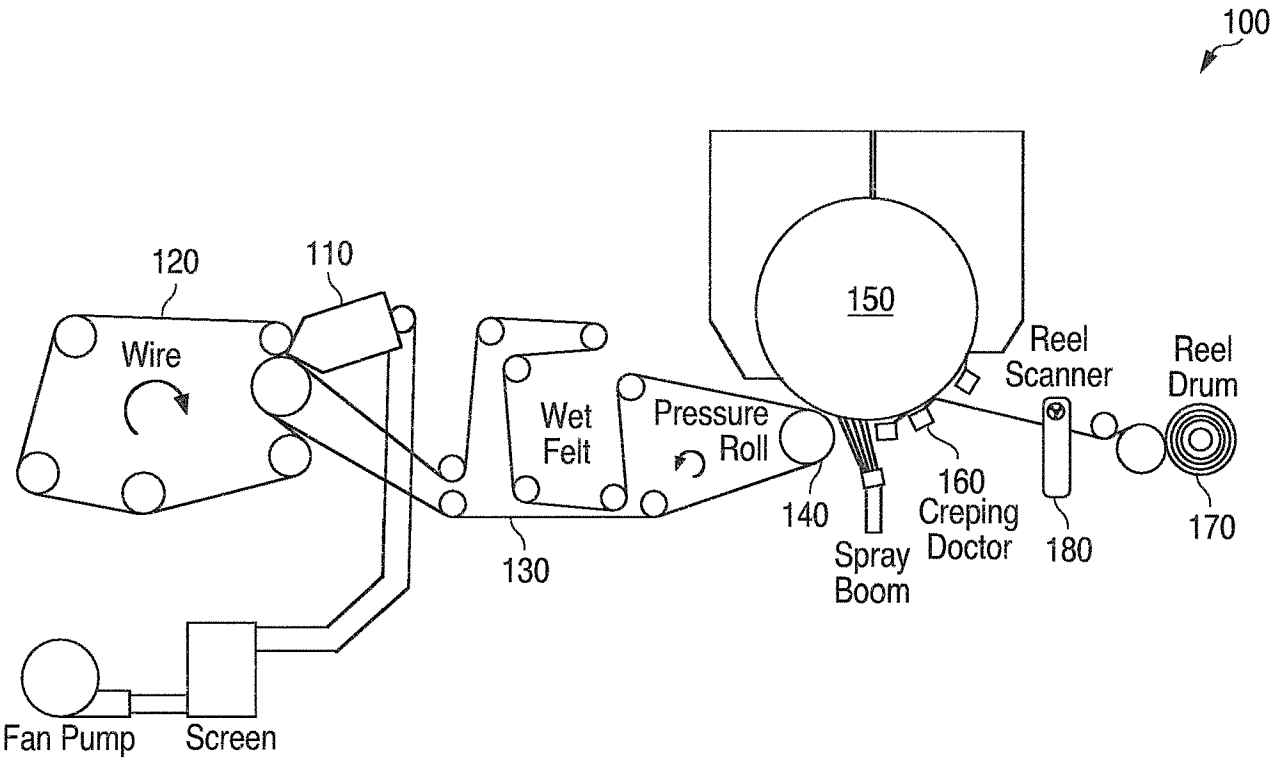
FIG. 1 (PRIOR ART)
FIG. 1 illustrates a schematic representation of an exemplary prior art machine for making creped tissue paper.
Figure 2:
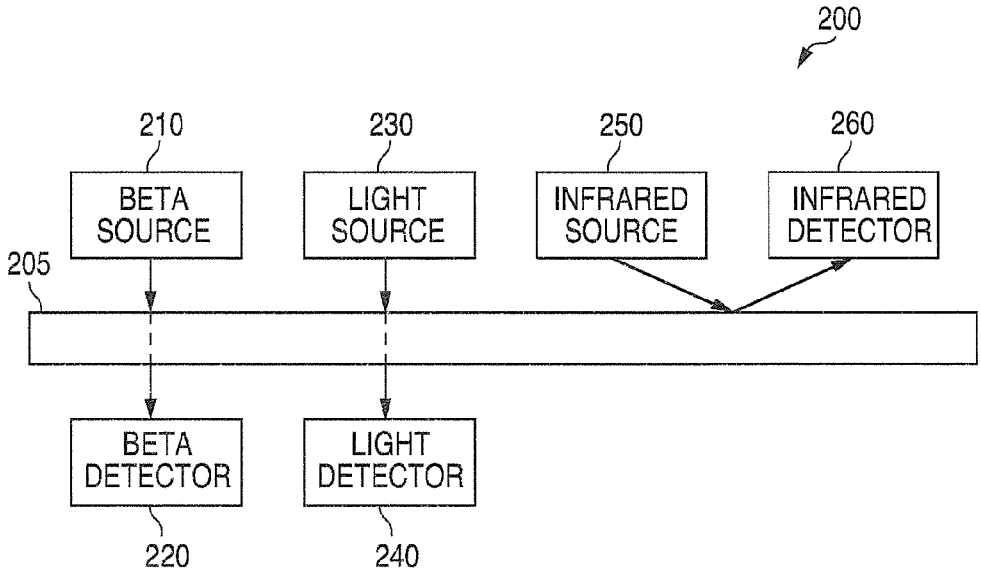
FIG. 2 (PRIOR ART)
FIG. 2 illustrates a schematic representation of three prior art basis weight measuring devices that are used to measure the basis weight of a creped web of paper fibers.
Figure 3:
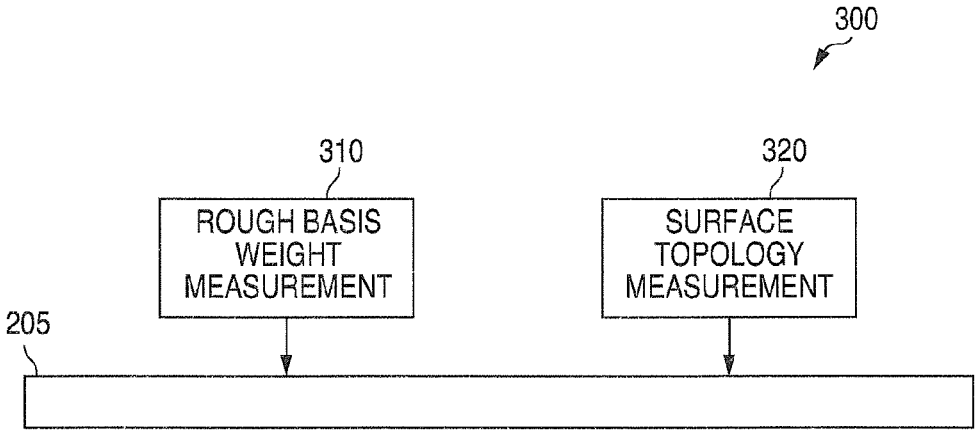
FIG. 3 illustrates a schematic representation of a prior art basis weight measurement of a creped web of paper fibers and a surface topology measurement of the creped web of paper fibers.

FIG. 3 illustrates a schematic representation 300 of a prior art basis weight measurement 310 of a creped web 205 of paper fibers and an adjacent surface topology measurement 320 of the creped web of paper fibers 205. The prior art basis weight measurement 310 provides a rough basis weight measurement of the web 205. The surface topology measurement 320 provides information about the actual surface topology of the web 205 at or very near the same location where the prior art basis weight measurement 310 was made.

The rough basis weight measurement 310 and the surface topology measurement 320 are shown in FIG. 3 as being located at separate adjacent positions of the web 205. The positions shown in FIG. 3 are shown separately for clarity of illustration. It is understood that the two measurements (310 and 320) of the web 205 can both be made at the same location of the web 205.

The rough basis weight measurement 310 of the web 205 can be made first and the surface topology measurement 320 of the web 205 can be made subsequently. Alternatively, the surface topology measurement 320 of the web 205 can be made first and the rough basis weight measurement 310 of the web 205 can be made subsequently.

Alternatively, in another advantageous embodiment of the invention, the two measurements can be made at the same time. In this alternative embodiment, the surface topology measurement 320 of the web 205 is made just in front of or just behind (or on either side of) the location where the rough basis weight measurement 310 is made.

Figure 4:
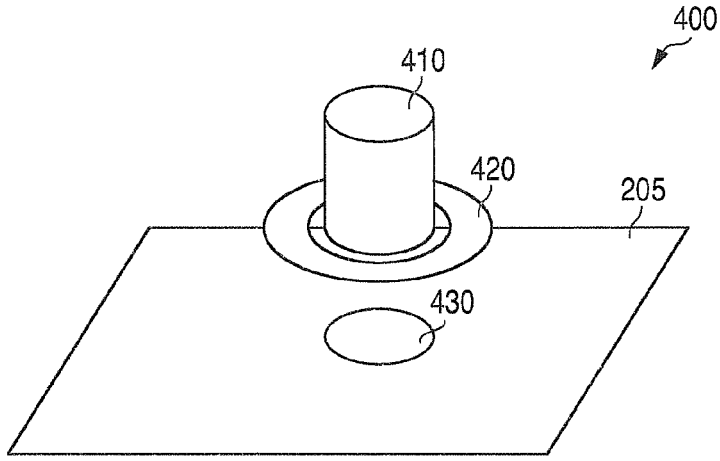
FIG. 4 illustrates a schematic perspective representation of a scanning camera of the present invention for making surface topology measurements of a creped web of paper fibers.

FIG. 4 illustrates a schematic perspective representation 400 of a scanning camera 410 of the present invention for making surface topology measurements of a creped web 205 of paper fibers. As shown in FIG. 4, the scanning camera 410 is located above the web 205 at an appropriate distance so that the scanning camera 410 can focus upon and photograph the upper surface of the web 205. The imaged area of the web 205 that is photographed by the scanning camera 410 is designated with reference numeral 430.

A scanning camera 410 is selected that is capable of taking very high resolution photographs. The scanning camera 410 is selected so that the resolution of the scanning camera 410 has a field pixel scale that is less than a typical fiber width of the creped web 205 of paper fibers. The scanning camera 410 is preferably provided with a plurality of high resolution lenses that are capable of resolving images with a twenty five millimeter (25 mm) field of view, with a thirty five millimeter (35 mm) field of view, or a fifty millimeter (50 mm) field of view.

An annular light source 420 is located near the end of the scanning camera 410 that is located adjacent to the surface of the web 205 that is to be photographed. The annular light source 420 is capable of providing fast strobe illumination that immobilizes photographic images on the surface of the web 205. The strobe time of the annular light source 420 is preferably less than one millisecond (1 ms). The bottom surface of the annular light source 420 is preferably located ten millimeters (10 mm) to twenty millimeters (20 mm) above the surface of the web 205. The field of the imaged area 430 is preferably larger than fifteen millimeters (15 mm).

Figure 5:
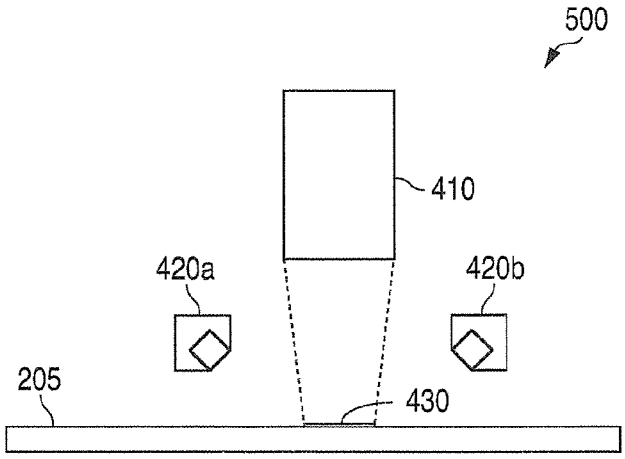
FIG. 5 illustrates a schematic cross sectional representation of a scanning camera of the present invention for making surface topology measurements of a creped web of paper fibers.

FIG. 5 illustrates a schematic cross sectional representation 500 of the scanning camera 410 of the present invention. The reference numerals that are shown in FIG. 4 also refer to the same elements in FIG. 5. The cross sectional view of FIG. 5 causes the annular ring 420 to be shown as two portions 420*a* and 420*b*.

The controller of the invention (described more fully below) is capable of using surface topology measurement data from the photograph of the imaged area 430 to obtain and provide a more accurate basis weight measurement for the web 205.

The scanning camera 410 and annular light source 420 that are shown in FIG. 4 and in FIG. 5 are capable of taking high resolution photographs of the top surface of the web 205. In an alternative advantageous embodiment of the invention it is also possible to use a second scanning camera and a second light source and take high resolution photographs of the bottom surface of the web 205.

Figure 6:
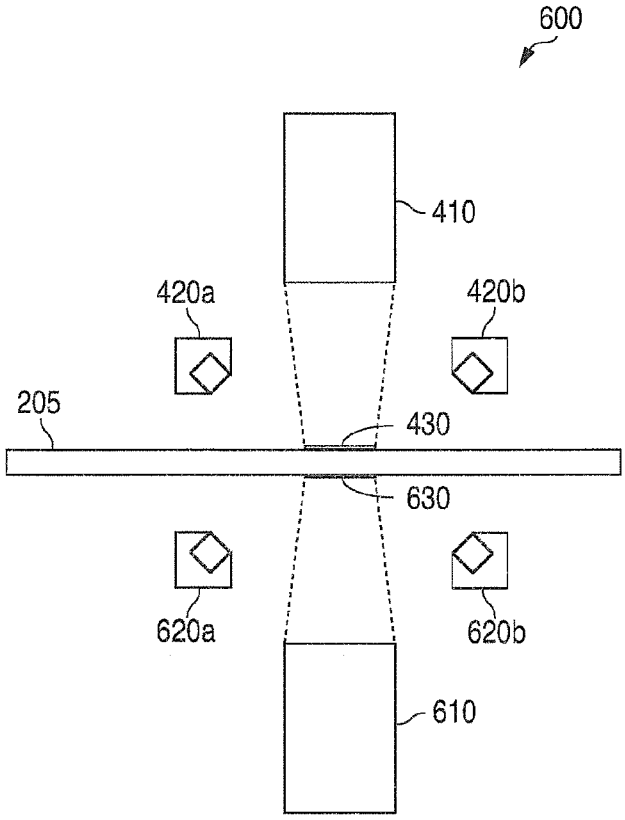
FIG. 6 illustrates a schematic cross sectional representation of an upper scanning camera and a lower scanning camera of the present invention for making surface topology measurements of a creped web of paper fibers.

FIG. 6 illustrates a schematic cross sectional representation 600 of an upper scanning camera 410 and an upper annular light source (420*a*, 420*b*) and a lower scanning camera 610 and a lower annular light source (620*a*, 620*b*) for making surface topology measurements of the web 205. The upper scanning camera 410 and upper annular light source (420*a*, 420*b*) are the same as that previously shown in FIG. 4 and in FIG. 5.

The lower scanning camera 610 and the lower annular light source (620*a*, 620*b*) have the same structure and function as the upper scanning camera 410 and the upper annular light source (420*a*, 420*b*). The imaged area of the bottom of the web 205 that is to be photographed by the scanning camera 610 is designated with reference numeral 630.

The upper scanning camera 410 takes high resolution photographs of the upper imaged area 430. At the same time the lower scanning camera 610 takes high resolution photographs of the lower imaged area 630. The controller of the invention is capable of using surface topology measurement data from the photograph of the imaged area 430 and from the photograph of the imaged area 630 to obtain and provide a more accurate basis weight measurement for the web 205.

Figure 7:
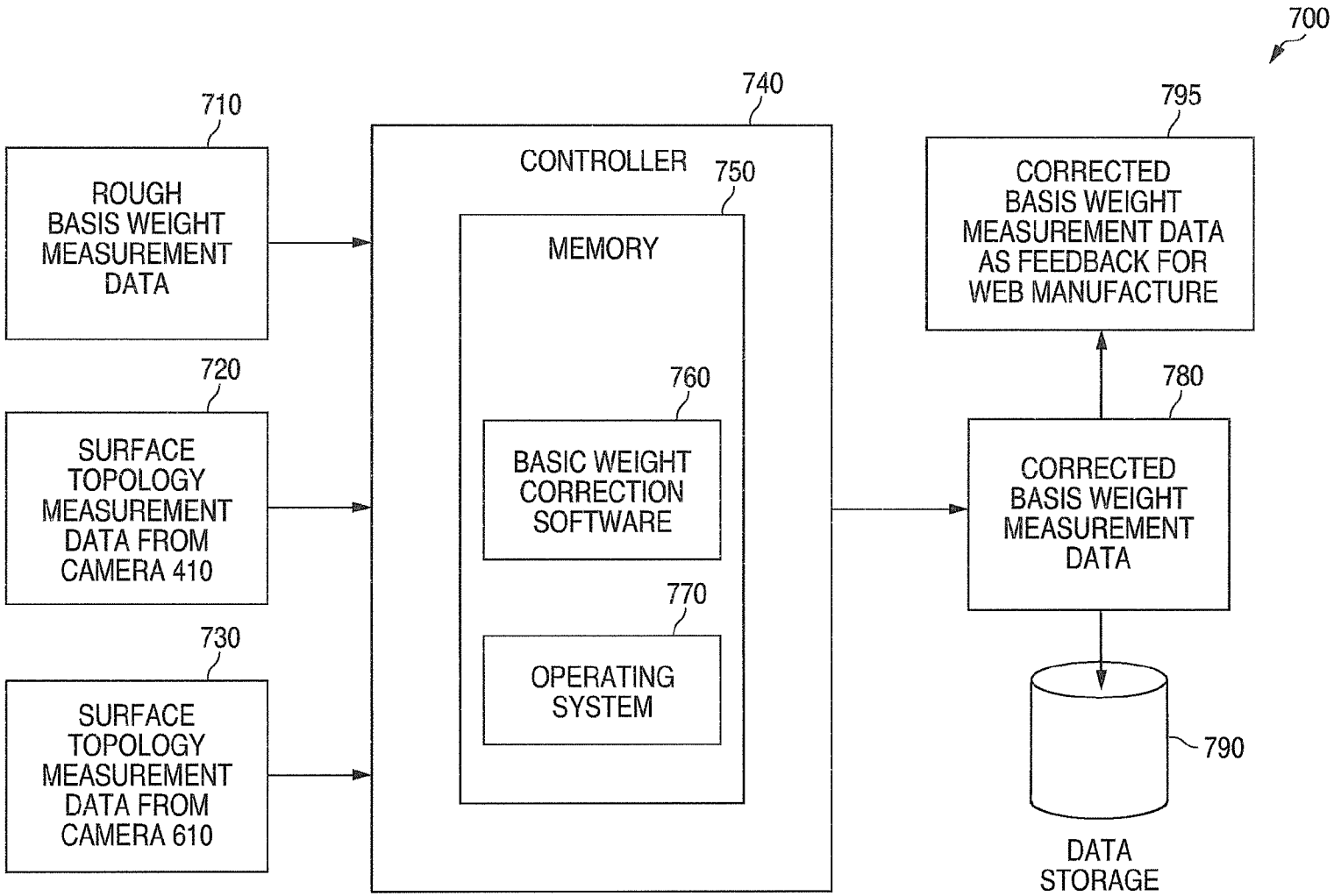
FIG. 7 illustrates a schematic representation of a controller of the present invention that combines surface topology measurement data of a creped web of paper fibers with rough basis weight measurement data of the creped web of paper fibers to obtain an accurate value of basis weight for the creped web of paper fibers.

FIG. 7 illustrates a schematic representation 700 of a controller 740 constructed in accordance with the principles of the present invention. The controller 740 is capable of receiving and combining rough basis weight measurement data 710 with surface topology measurement data 720 from the scanning camera 410. The controller is also capable of receiving and combining rough basis weight measurement data 710 with surface topology measurement data 730 from the scanning camera 610.

As shown in FIG. 7, controller 740 comprises a memory 750 that contains computer software 760 of the present invention. The computer software 760 is also referred to as basis weight correction software 760. Memory 750 also contains an operating system 770 that performs the ordinary and well known functions of a computer operating system.

Memory 750 may comprise random access memory (RAM) or a combination of random access memory (RAM) and read only memory (ROM). Memory 750 may comprise a non-volatile random access memory (RAM), such as flash memory. Memory 760 may also comprise a mass storage device, such as a hard disk drive (not shown).

The controller 740 and the basis weight correction software 760 together comprise a basis weight correction controller that is capable of carrying out the present invention. Under the direction of the computer instructions in the basis weight correction software 760 stored within memory 750, the controller 740 performs the functions described below. The controller 740 receives rough basis weight measurement data 710 from a basis weight measurement of the web 205 that has been performed by a prior art basis weight measuring device.

The controller 740 also receives surface topology measurement data 720 from a high resolution photograph of the web 205 that has been performed by the upper scanning camera 410. In an alternative advantageous embodiment of the invention, the controller 740 also receives surface topology measurement data 730 from a high resolution photograph of the web 205 that has been performed by the lower scanning camera 610.

The direction of motion of the web 205 is referred to as the machine direction (MD). The direction across the web 205 that is perpendicular to the machine direction is referred to as the cross direction (CD). Under the direction of the computer instructions in the basis weight correction software 760 stored within memory 750, the controller 740 performs image analysis to measure the dimensions of the crepe features in the surface of the web 205. The variations in the dimensions of the crepe features in the surface of the web 205 create the surface topology of the web 205.

The controller 740 determines the average dimension of the crepe topological features in the machine direction (MD). The controller 740 also determines the average dimension of the crepe topological features in the cross direction (CD). The controller 740 also determines the dominant frequency of the crepe topological features in the web 205. In particular, the controller 740 determines a measurement of the crepe wavelength and determines a measurement of the crepe peak height.

The controller 740 is capable of measuring the crepe quality of the web 205 in an on-line real time manner. If the crepe quality of the 205 decreases substantially during the manufacturing process, then the controller 740 will quickly determine the quality decrease and activate an appropriate alarm signal.

The controller 740 utilizes the surface topological data of the web 205 to provide corrections to the rough basis weight measurement data 710. In particular, the controller 740 uses the values of the crepe wavelength and the values of the height of the crepe peaks as described more fully below.

Let the rough basis weight measurement data 710 be designated with the letter B. The rough measurement of basis weight B is measured after creping. The creped web 205 can be stretched or compacted depending upon the point where the rough basis weight measurement is made. To compensate for the variable amount of crepe in the creped web 205, a compensated basis weight B' is needed that provides a correction to the rough basis weight measurement B.

Figure 8:
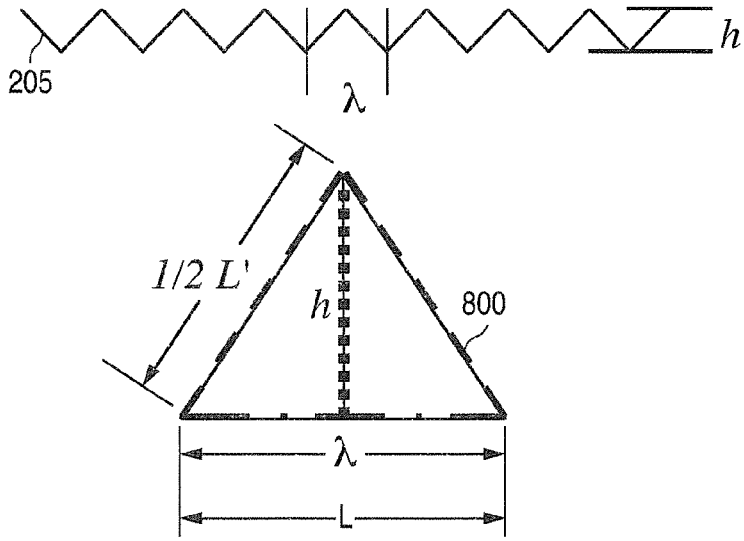
FIG. 8 illustrates a schematic representation of a triangular waveform of an individual creped peak in a creped web of paper fibers.

A simplified model is used to describe the creped web 205. It is understood that a more complicated model could also be used. FIG. 8 illustrates a schematic representation of a triangular waveform of an individual creped peak in the creped web 205 of paper fibers. The creped web 205 can be represented as a series of individual creped peaks that have a triangular waveform. The Greek letter lambda (λ) represents a measure of the wavelength (taken as the base width) of each one of the individual creped peaks. The letter h represents the height of each one of the individual creped peaks of the creped web 205.

The triangle 800 schematically represents the triangular structure of one creped peak. The basis weight sensor would see a length of paper represented by the letter L. The real length of the web material after creping is represented by the letter L'. The new length L' after creping is equal to twice the length of the hypotenuse of a triangle with height h and base λ/2. The new length L' is given by the equation:

$$L' = 2\sqrt{h^2 + \left(\frac{\lambda}{2}\right)^2} \tag{1}$$

As the value of h approaches zero, the value of L' approaches the value λ (which is also equal to the flat value L). Assuming that the measured area is rectangular then the measured area is equal to the length times the width. Therefore the effective measured area must be corrected by the ratio of the new length to the old length plus the constant offset of a function of the angular velocity ratio $$f\left(\frac{\omega_Y}{\omega_R}\right)$$

of the creping cylinder 150 (Yankee dryer 150) and the reel drum 170. The term $\omega_Y$ represents the angular velocity of the creping cylinder 150 (Yankee dryer 150) and the term $\omega_R$ represents the angular velocity of the reel drum 170.

The rough measurement of basis weight B may be corrected by multiplying by the factor L'/L and adding the constant offset of the angular velocity ratio. This gives the corrected basis weight B':

$$B' = B\frac{L'}{L} + f\left(\frac{\omega_Y}{\omega_R}\right) \tag{2}$$

An alternative expression for the corrected basis weight B' in terms of the height h and the wavelength λ is:

$$B' = \frac{2B\sqrt{h^2 + \left(\frac{\lambda}{2}\right)^2}}{\lambda} + f\left(\frac{\omega_Y}{\omega_R}\right) \tag{3}$$

Equation (2) and Equation (3) provide a value for the corrected basis weight measurement data 780 (designated with the letter B').

As shown in FIG. 7, the corrected basis weight measurement data 780 may be stored in a data storage unit 790 for future retrieval and use. The corrected basis weight measurement data 780 may also be used as a feedback value 795 for a process in the manufacture of the web 205. For example, the corrected basis weight measurement data 780 may be used to control the operation of a fan pump that meters the paper fiber stock into the headbox 110. The corrected basis weight measurement data 780 may also be used to determine when to change the creping blade in the creping doctor 160.

The principles of the present invention may also be used to correct a rough measurement of water weight for the web 205. A prior art infrared measuring device may be used to determine the water content of the web 205. The water content is of the web 205 is expressed as the amount of water that is contained in a unit area of the web 205. Like the basis weight parameter, the water weight parameter is usually expressed in terms of grams per square meter.

Figure 9:
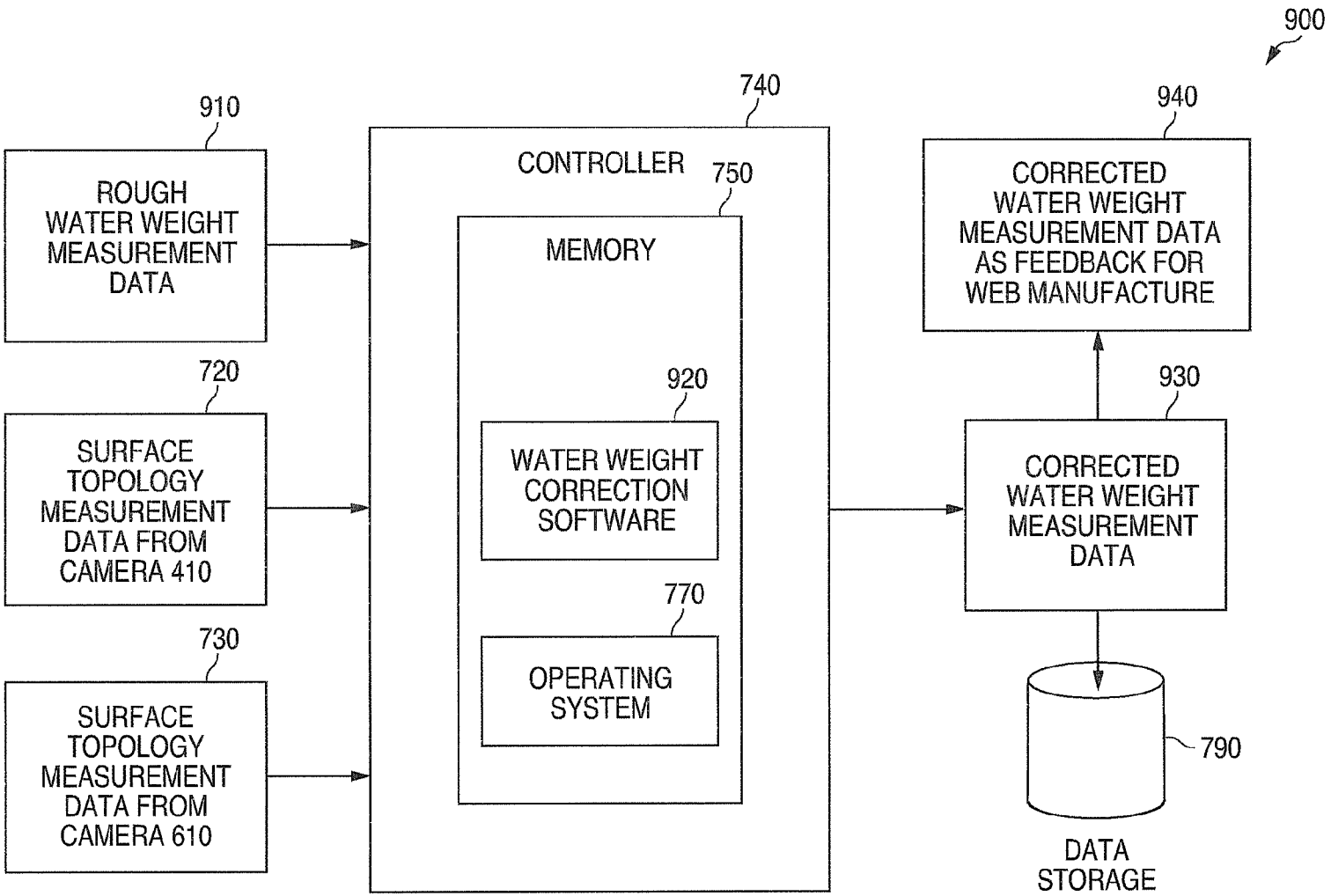
FIG. 9 illustrates a schematic representation of a controller of the present invention that combines surface topology measurement data of a creped web of paper fibers with rough water weight measurement data of the creped web of paper fibers to obtain an accurate value of water weight for the creped web of paper fibers.

As shown in FIG. 9, the controller 740 is capable of receiving and combining rough water weight measurement data 910 with surface topology measurement data 720 from the scanning camera 410. The controller is also capable of receiving and combining rough water weight measurement data 910 with surface topology measurement data 730 from the scanning camera 610.

As shown in FIG. 9, controller 740 comprises a memory 750 that may contain water weight correction software 920. The controller 740 utilizes the surface topological data of the web 205 to provide corrections to the rough water weight measurement data 910. In particular, the controller 740 uses the values of the crepe wavelength and the values of the height of the crepe peaks in the same manner as that previously described in the case of the basis weight measurement data 710.

The rough water weight measurement data 910 (designated with the letter W) may be corrected by multiplying by the factor L'/L and adding the constant offset of the function of the angular velocity ratio. This gives the corrected water weight (designated with the letter W'):

$$W' = W\frac{L'}{L} + f\left(\frac{\omega_Y}{\omega_R}\right) \tag{4}$$

An alternative expression for the corrected water weight W' in terms of the height h and the wavelength λ is:

$$W' = \frac{2W\sqrt{h^2 + \left(\frac{\lambda}{2}\right)^2}}{\lambda} + f\left(\frac{\omega_Y}{\omega_R}\right) \tag{5}$$

Equation (4) and Equation (5) provide a value for the corrected water weight measurement data 930 (designated with the letter W').

As shown in FIG. 9, the corrected water weight measurement data 930 may be stored in a data storage unit 790 for future retrieval and use. The corrected water weight measurement data 930 may also be used as a feedback value 940 for a process in the manufacture of the web 205.

The corrected value of basis weight B' and the corrected value of water weight W' may be used to calculate a corrected value of percent moisture for the web 205. In particular, the corrected value of percent moisture for the web 205 may be calculated as follows:

$$\text{Percent moisture} = \frac{\text{Corrected Water Weight}(W')}{\text{Corrected Basis Weight}(B')} \times 100 \quad (6)$$

Equation (6) provides a corrected value for the percent moisture for the web 205.

The basis weight parameter of the web 205 and the water weight parameter of the web 205 are both examples of an areal weight parameter. An areal weight parameter is a parameter that is measured based upon a measurement per unit area of measure. In the case of the basis weight parameter it is the weight (or mass) of the paper fiber material of the web 205 per unit area. In the case of the water weight parameter it is the amount of water in the web 205 per unit area.

The principles of the present invention are applicable to any type of areal weight parameter. That it, the use of the surface topology information may be used to increase the accuracy of measurement of any areal weight parameter. This feature of the present invention is illustrated in FIG. 10.

Figure 10:
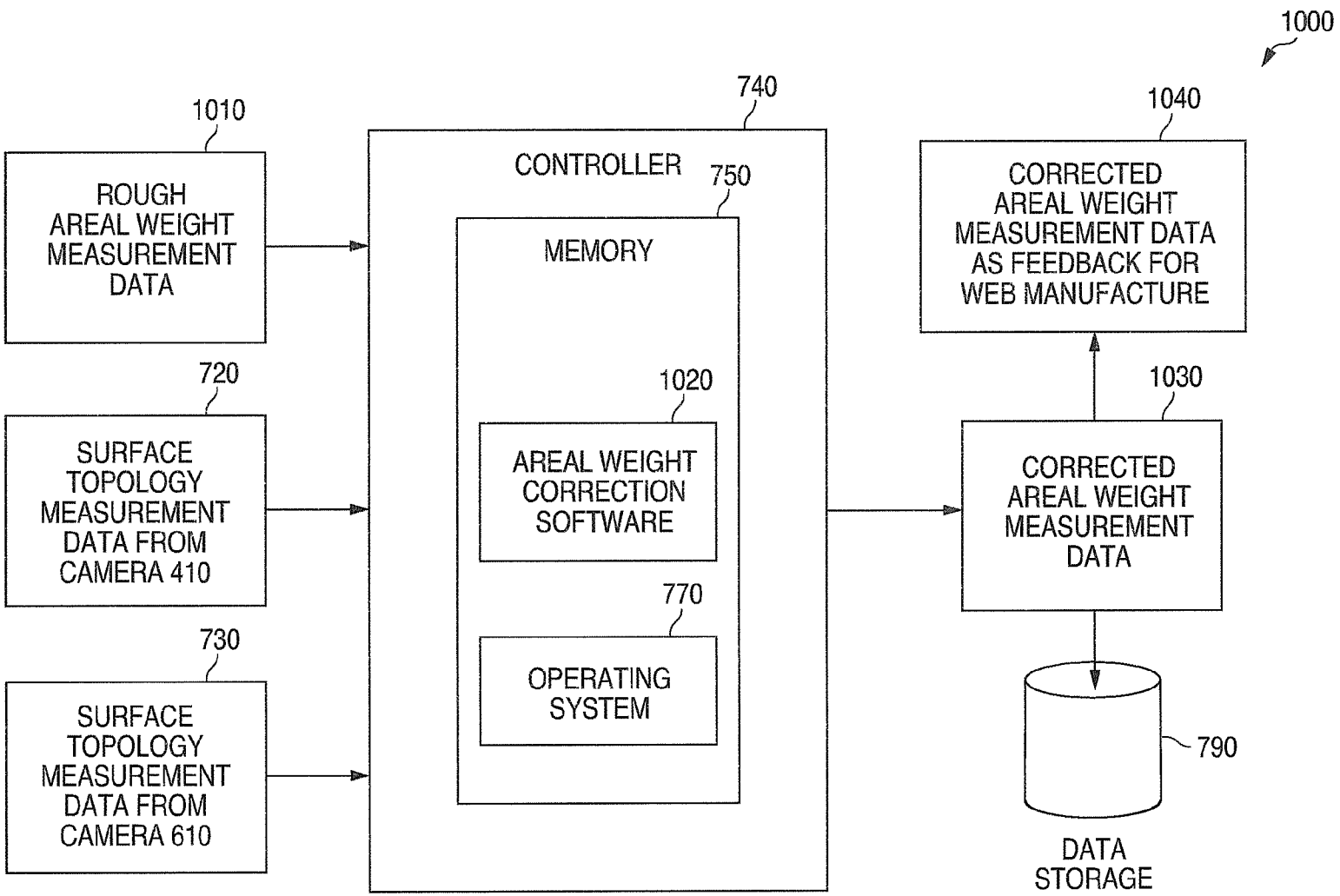
FIG. 10 illustrates a schematic representation of a controller of the present invention that combines surface topology measurement data of a creped web of paper fibers with rough areal weight measurement data of the creped web of paper fibers to obtain an accurate value of areal weight for the creped web of paper fibers.

As shown in FIG. 10, the controller 740 is capable of receiving and combining rough areal weight measurement data 1010 with surface topology measurement data 720 from the scanning camera 410. The controller is also capable of receiving and combining rough areal weight measurement data 1010 with surface topology measurement data 730 from the scanning camera 610.

Controller 740 comprises a memory 750 that may contain areal weight correction software 1020. The controller 740 utilizes the surface topological data of the web 205 to provide corrections to the rough areal weight measurement data 1010.

The corrected areal weight measurement data 1030 may be stored in a data storage unit 790 for future retrieval and use. The corrected areal weight measurement data 1030 may also be used as a feedback value 1040 for a process in the manufacture of the web 205.

Figure 11:
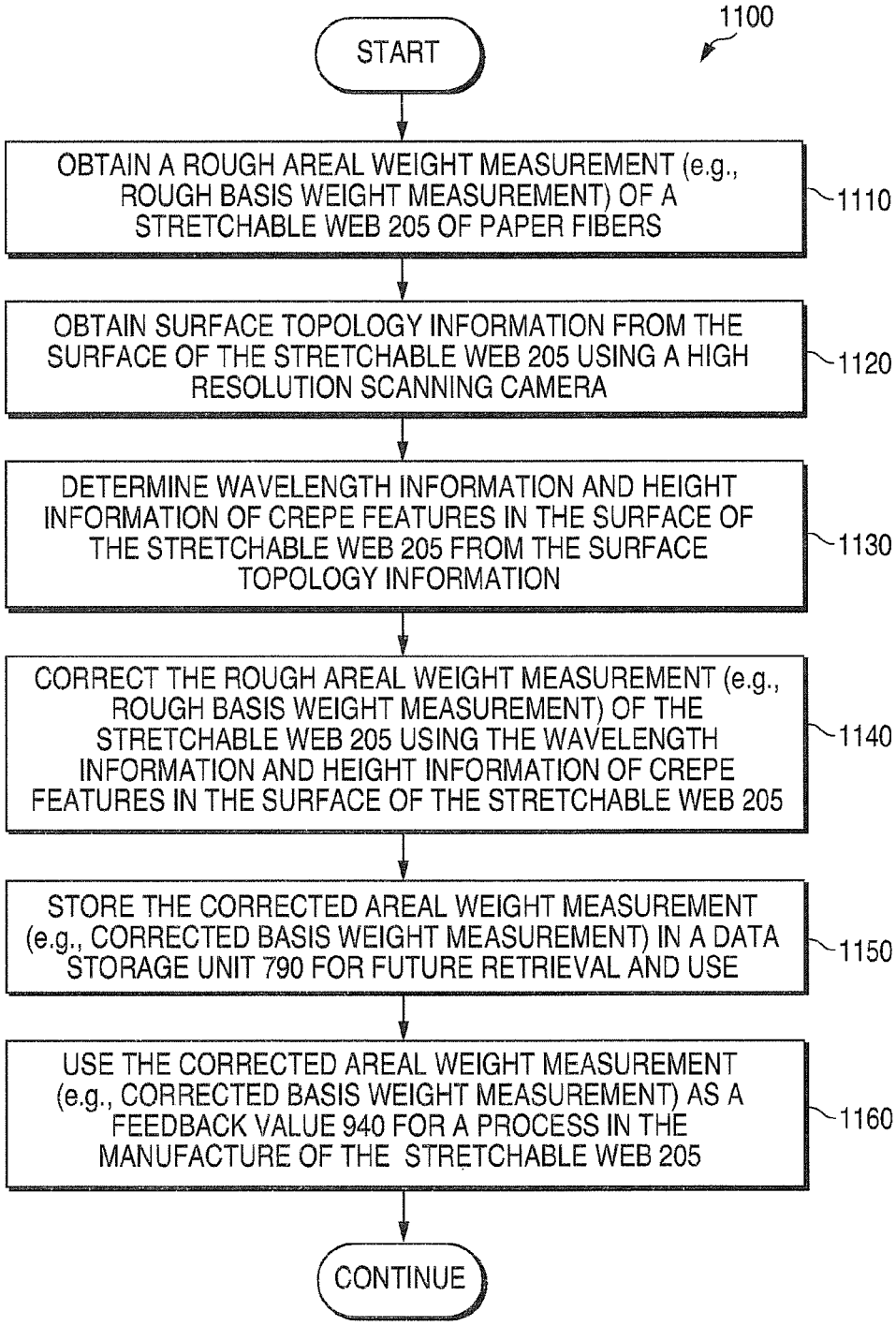
FIG. 11 illustrates a flow chart showing the steps of an advantageous embodiment of the method of the present invention.

FIG. 11 illustrates a flow chart 1100 that shows the steps of an advantageous embodiment of the method of the present invention. In the first step a rough areal weight measurement (e.g., rough basis weight measurement) of a stretchable web 205 of paper fibers is obtained (step 1110). Then surface topology information is obtained from the surface of the stretchable web 205 using a high resolution scanning camera (step 1120).

Then wavelength information and height information of crepe features in the surface of the stretchable web 205 is determined from the surface topology information (step 1130). The rough areal weight measurement (e.g., rough basis weight measurement) is then corrected using the wavelength information and height information of the crepe features in the surface of the stretchable web 205 (step 1140).

The corrected areal weight measurement (e.g., corrected basis weight measurement) is then stored in a data storage unit 790 for future retrieval and use (step 1150). The corrected areal weight measurement (e.g., corrected basis weight measurement) is used as a feedback value 940 for a process in the manufacture of the stretchable web 205 (step 1160).

It may be advantageous to set forth definitions of certain words and phrases used throughout this patent document. The terms "application," "program," and "routine" refer to one or more computer programs, sets of instructions, procedures, functions, objects, classes, instances, or related data adapted for implementation in a suitable computer language. The term "couple" and its derivatives refer to any direct or indirect communication between two or more elements, whether or not those elements are in physical contact with one another.

The terms "transmit," "receive," and "communicate," as well as derivatives thereof, encompass both direct and indirect communication. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like. The term "controller" means any device, system, or part thereof that controls at least one operation. A controller may be implemented in hardware, firmware, software, or some combination of at least two of the same. The functionality associated with any particular controller may be centralized or distributed, whether locally or remotely.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of the invention, as defined by the following claims.

What is claimed is:

1. An apparatus comprising:

an areal weight measuring device configured to obtain a rough areal weight measurement of a stretchable web;

a surface topology measuring device configured to obtain surface topology measurement data from a surface of the stretchable web, wherein the surface topology measuring device comprises at least one camera; and an areal weight correction controller configured to correct the rough areal weight measurement using the surface topology measurement data.

2. The apparatus as set forth in claim 1, wherein the at least one camera comprises a first high resolution scanning camera located adjacent to a first side of the stretchable web.

3. The apparatus as set forth in claim 2, wherein the at least one camera further comprises a second high resolution scanning camera located adjacent to a second side of the stretchable web.

4. The apparatus as set forth in claim 1, wherein the rough areal weight measurement comprises a rough basis weight measurement.

5. The apparatus as set forth in claim 4, wherein the areal weight correction controller comprises a basis weight correction controller configured to correct the rough basis weight measurement using crepe wavelength information and crepe peak height information from the surface topology measurement data.

6. The apparatus as set forth in claim 5, wherein the basis weight correction controller is configured to correct the rough basis weight measurement using a formula of:

$$B' = \frac{2B\sqrt{h^2 + \left(\frac{\lambda}{2}\right)^2}}{\lambda} + f\left(\frac{\omega_Y}{\omega_R}\right)$$

where B represents the rough basis weight measurement;

where h represents the crepe peak height information;

where λ represents the crepe wavelength information;

where $$f\left(\frac{\omega_Y}{\omega_R}\right)$$

represents a function of a ratio between an angular velocity $\omega_Y$ of a creping cylinder and an angular velocity $\omega_R$ of a reel drum; and where B' represents a corrected basis weight measurement.

7. An apparatus comprising:

an areal weight measuring device configured to obtain a rough areal weight measurement of a stretchable web;

a surface topology measuring device configured to obtain surface topology measurement data from a surface of the stretchable web; and an areal weight correction controller configured to correct the rough areal weight measurement using the surface topology measurement data, wherein the areal weight correction controller is configured to correct the rough areal weight measurement using crepe wavelength information and crepe peak height information from the surface topology measurement data.

8. The apparatus as set forth in claim 7, wherein:

the rough areal weight measurement comprises a rough basis weight measurement; and the areal weight correction controller comprises a basis weight correction controller configured to correct the rough basis weight measurement using the crepe wavelength information and the crepe peak height information.

9. An apparatus comprising:

an areal weight measuring device configured to obtain a rough areal weight measurement of a stretchable web;

a surface topology measuring device configured to obtain surface topology measurement data from a surface of the stretchable web; and an areal weight correction controller configured to correct the rough areal weight measurement using the surface topology measurement data;

wherein the rough areal weight measurement comprises a rough water weight measurement.

10. The apparatus as set forth in claim 9, wherein the areal weight correction controller comprises a water weight correction controller configured to correct the rough water weight measurement using crepe wavelength information and crepe peak height information from the surface topology measurement data.

11. The apparatus as set forth in claim 10, wherein the water weight correction controller is configured to correct the rough water weight measurement using a formula of:

$$W' = \frac{2W\sqrt{h^2 + \left(\frac{\lambda}{2}\right)^2}}{\lambda} + f\left(\frac{\omega_Y}{\omega_R}\right)$$

where W represents the rough water weight measurement;

where h represents the crepe peak height information;

where λ represents the crepe wavelength information;

where $$f\left(\frac{\omega_Y}{\omega_R}\right)$$

represents a function of a ratio between an angular velocity $\omega_Y$ of a creping cylinder and an angular velocity $\omega_R$ of a reel drum; and where W' represents a corrected water weight measurement.

12. An apparatus comprising:

a basis weight measuring device configured to obtain a rough basis weight measurement of a stretchable web;

a water weight measuring device configured to obtain a rough water weight measurement of the stretchable web;

a surface topology measuring device configured to obtain surface topology measurement data from a surface of the stretchable web; and a controller configured to correct the rough basis weight measurement and to correct the rough water weight measurement using the surface topology measurement data to generate a corrected water weight measurement and a corrected basis weight measurement;

wherein the controller is configured to determine a percent moisture value of the stretchable web by dividing a value of the corrected water weight measurement by a value of the corrected basis weight measurement and by multiplying a result by one hundred.

13. The apparatus as set forth in claim 12, wherein the surface topology measuring device comprises a first high resolution scanning camera located adjacent to a first side of the stretchable web.

14. The apparatus as set forth in claim 13, wherein the surface topology measuring device further comprises a second high resolution scanning camera located adjacent to a second side of the stretchable web.

15. A method comprising the steps of:

measuring a stretchable web with an areal weight measuring device to obtain a rough areal weight measurement of the stretchable web;

measuring a surface of the stretchable web with a surface topology measuring device to obtain surface topology measurement data from the surface of the stretchable web;

correcting the rough areal weight measurement using the surface topology measurement data to generate a corrected areal weight measurement; and using the corrected areal weight measurement as a feedback value in a manufacturing process of the stretchable web.

16. The method as set forth in claim 15, wherein the step of measuring the surface of the stretchable web with the surface topology measuring device comprises the step of:

measuring the surface of the stretchable web with a first high resolution scanning camera located adjacent to a first side of the stretchable web.

17. The method of claim 16, wherein the step of measuring the surface of the stretchable web with the surface topology measuring device further comprises the step of:

measuring the surface of the stretchable web with a second high resolution scanning camera located adjacent to a second side of the stretchable web.

18. The method as set forth in claim 15, wherein the rough areal weight measurement comprises a rough basis weight measurement.

19. The method as set forth in claim 18, wherein correcting the rough areal weight measurement comprises the step of:

correcting the rough basis weight measurement using crepe wavelength information and crepe peak height information from the surface topology measurement data and using a formula of:

$$B' = \frac{2B\sqrt{h^2 + \left(\frac{\lambda}{2}\right)^2}}{\lambda} + f\left(\frac{\omega_Y}{\omega_R}\right)$$

where B represents the rough basis weight measurement;

where h represents the crepe peak height information;

where λ represents the crepe wavelength information;

where $$f\left(\frac{\omega_Y}{\omega_R}\right)$$

represents a function of a ratio between an angular velocity $\omega_Y$ of a creping cylinder and an angular velocity $\omega_R$ of a reel drum; and where B' represents a corrected basis weight measurement.

20. The method as set forth in claim 15, wherein the rough areal weight measurement comprises a rough water weight measurement.

21. The method as set forth in claim 20, wherein correcting the rough areal weight measurement comprises the step of:

correcting the rough water weight measurement using crepe wavelength information and crepe peak height information from the surface topology measurement data and using a formula of:

$$W' = \frac{2W\sqrt{h^2 + \left(\frac{\lambda}{2}\right)^2}}{\lambda} + f\left(\frac{\omega_Y}{\omega_R}\right)$$

where W represents the rough water weight measurement;

where h represents the crepe peak height information;

where λ represents the crepe wavelength information;

where $$f\left(\frac{\omega_Y}{\omega_R}\right)$$

represents a function of a ratio between an angular velocity $\omega_Y$ of a creping cylinder and an angular velocity $\omega_R$ of a reel drum; and where W' represents a corrected water weight measurement.

22. The method as set forth in claim 15, wherein:

measuring the stretchable web with the areal weight measuring device comprises:

measuring the stretchable web with a basis weight measuring device to obtain a rough basis weight measurement of the stretchable web; and measuring the stretchable web with a water weight measuring device to obtain a rough water weight measurement of the stretchable web;

correcting the rough areal weight measurement comprises correcting the rough basis weight measurement and the rough water weight measurement using the surface topology measurement data to generate a corrected basis weight measurement and a corrected water weight measurement; and using the corrected areal weight measurement as the feedback value comprises:

determining a percent moisture value of the stretchable web by dividing a value of the corrected water weight measurement by a value of the corrected basis weight measurement and by multiplying a result by one hundred; and using the percent moisture value as the feedback value.

23. An apparatus comprising:

an areal weight measuring device configured to obtain a rough areal weight measurement of a stretchable web;

a surface topology measuring device configured to obtain surface topology measurement data from a surface of the stretchable web; and an areal weight correction controller configured to adjust the rough areal weight measurement using the surface topology measurement data in order to generate a more accurate corrected areal weight measurement of the stretchable web.

24. The apparatus of claim 23, wherein the areal weight correction controller is further configured to provide the corrected areal weight measurement as a feedback value in a manufacturing process of the stretchable web.

25. A tangible computer readable medium embodying a computer program, the computer program comprising instructions for:

receiving a rough areal weight measurement of a stretchable web;

receiving surface topology measurement data associated with a surface of the stretchable web; and adjusting the rough areal weight measurement using the surface topology measurement data in order to generate a more accurate corrected areal weight measurement of the stretchable web.

* * * * *